US011478894B2

(12) United States Patent
Wiswell

(10) Patent No.: US 11,478,894 B2
(45) Date of Patent: Oct. 25, 2022

(54) POLISHING FLUID ADDITIVE CONCENTRATION MEASUREMENT APPARATUS AND METHODS RELATED THERETO

(71) Applicant: Applied Materials, Inc., Santa Clara, CA (US)

(72) Inventor: Nicholas Alexander Wiswell, San Jose, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 808 days.

(21) Appl. No.: 16/282,874

(22) Filed: Feb. 22, 2019

(65) Prior Publication Data

US 2019/0275632 A1 Sep. 12, 2019

Related U.S. Application Data

(60) Provisional application No. 62/639,837, filed on Mar. 7, 2018.

(51) Int. Cl.
*B24B 37/013* (2012.01)
*B24B 37/04* (2012.01)
(Continued)

(52) U.S. Cl.
CPC ..... *B24B 37/013* (2013.01); *B24B 37/005* (2013.01); *B24B 37/042* (2013.01); *B24B 49/12* (2013.01); *B24B 57/02* (2013.01)

(58) Field of Classification Search
CPC ..... B24B 1/00; B24B 37/005; B24B 37/0056; B24B 37/042; B24B 37/044; B24B 49/04;
(Continued)

(56) References Cited

U.S. PATENT DOCUMENTS 5,483,568 A 1/1996 Yano et al.
5,658,183 A * 8/1997 Sandhu ..... B23Q 15/013 451/6
(Continued)

FOREIGN PATENT DOCUMENTS

JP H10-209091 A 8/1998
JP 2001-223190 A 8/2001
JP 2007129115 A 5/2007

OTHER PUBLICATIONS

PCT International Search Report and Written Opinion dated May 31, 2019, for International Application No. PCT/US2019/018603.
(Continued)

*Primary Examiner* — Joel D Crandall
*Assistant Examiner* — Robert F Neibaur
(74) *Attorney, Agent, or Firm* — Patterson + Sheridan, LLP

(57) ABSTRACT

Methods and apparatus for monitoring and controlling relative concentrations of polishing fluid additives and, or, the distribution of a polishing fluid and, or, polishing fluid additives across the surface of a polishing pad during chemical mechanical planarization (CMP) of a substrate are provided herein. In one embodiment, a method for polishing a substrate includes delivering a polishing fluid to one or more locations on a polishing surface of a polishing pad, wherein the polishing fluid comprises an optical marker; detecting optical information at a plurality of locations across a scan region of the polishing surface using an optical sensor facing theretowards; communicating the optical information to a system controller; determining a polishing fluid distribution across the scan region using the optical information; and changing an aspect of the delivery of the polishing fluid based on the polishing fluid distribution.

17 Claims, 3 Drawing Sheets

(51) Int. Cl.
*B24B 37/005* (2012.01)
*B24B 57/02* (2006.01)
*B24B 49/12* (2006.01)

(58) Field of Classification Search
CPC ..... B24B 49/045; B24B 49/08; B24B 49/12; B24B 57/02
USPC ..... 451/5, 6, 8, 36, 41, 60, 285, 287
See application file for complete search history.

(56) References Cited

U.S. PATENT DOCUMENTS

| | | | | |
|---|---|---|---|---|
| 5,733,176 | A | 3/1998 | Robinson et al. | |
| 6,247,998 | B1 * | 6/2001 | Wiswesser | B24B 37/013 451/6 |
| 6,517,413 | B1 | 2/2003 | Hu et al. | |
| 6,657,726 | B1 * | 12/2003 | Wang | B24B 57/02 356/440 |
| 8,460,507 | B2 | 6/2013 | Spiro et al. | |
| 9,242,339 | B2 * | 1/2016 | Matsuo | B24B 37/005 |
| 9,305,851 | B2 | 4/2016 | Liu et al. | |
| 11,389,922 | B2 * | 7/2022 | Han | B24B 49/12 |
| 2003/0139048 | A1 | 7/2003 | Wong et al. | |
| 2014/0020830 | A1 | 1/2014 | Rangarajan et al. | |
| 2014/0206259 | A1 | 7/2014 | Benvegnu et al. | |

OTHER PUBLICATIONS

JP Office Acion dated Nov. 2, 2021 for Application No. 2020-545775.

* cited by examiner

POLISHING FLUID ADDITIVE CONCENTRATION MEASUREMENT APPARATUS AND METHODS RELATED THERETO

CROSS-REFERENCE TO RELATED APPLICATIONS

This application claims priority to U.S. Provisional Application Ser. No. 62/639,837 filed on Mar. 7, 2018, which is herein incorporated by reference in its entirety.

BACKGROUND

Field

Embodiments described herein generally relate to chemical mechanical planarization (CMP) of a substrate in an electronic device fabrication process, and more particularly, to methods of detecting and controlling the distribution of polishing fluids delivered to a polishing pad surface and, or, the concentration of polishing fluid additives in the polishing fluid, and apparatus related thereto.

Description of the Related Art

Chemical mechanical polishing (CMP) is commonly used in the manufacture of high-density integrated circuits to planarize or polish a layer of material deposited on a substrate, by contacting the material layer to be planarized with a polishing pad mounted on a polishing platen, and moving the polishing pad and, or, the substrate (and thus the material layer surface on the substrate) with respect to each other in the presence of a polishing fluid.

Typically, the polishing fluid is delivered to the polishing pad using a fluid delivery arm positioned thereover. Delivered polishing fluid flowrates are often monitored using a flowmeter and, or, a flow controller positioned in, or on, delivery lines leading to the fluid delivery arm. However, once the polishing fluid is dispensed from the delivery arm, methods for monitoring and, or, controlling the polishing fluid distribution across the polishing pad surface are often inadequate. Insufficient distribution of polishing fluid across the polishing surface can cause inconsistent polishing results, including inconsistent removal rates of the material layer being planarized, poor removal rate uniformity of the material layer being polished measured across the substrate, poor planarization or process planarization efficiency in removing protrusions in the material layer surface, poor within die material layer thickness uniformity, and increased defectivity, for example micro-scratches on the substrate surface (typically due to insufficient polishing fluid and thus insufficient lubrication between the substrate and the polishing pad). Often in CMP processes, more polishing fluid than actually required is dispensed onto the polishing pad to ensure sufficient distribution thereof, which undesirably increases the cost of processing a substrate.

Further, polishing fluids comprising one or more additives are typically delivered to a manufacturing facility pre-mixed with water or one or more reactive agents or are mixed using a bulk fluid distribution system before delivery to multiple use points, such as multiple polishing systems, within the manufacturing facility. Typically, the bulk fluid distribution system includes one or more precision inline concentration measuring devices and one or more analytic devices to control and monitor the additive concentrations in the polishing fluid. Often, specific CMP processes would benefit from in-situ mixing of polishing fluids at or near the point-of-use, such as for polishing fluids delivered to a particular polishing platen of a particular polishing system, to enable fine control over additive concentrations for a particular CMP process or for a particular portion of a CMP process sequence.

Unfortunately, conventional analytic methods and devices are too slow or cost prohibitive to enable sufficient control of in-situ point-of-use mixing of polishing fluids in a high volume manufacturing facility.

Accordingly, there is a need in the art for methods and apparatus to monitor and control the distribution of polishing fluids on a surface of a polishing pad during a CMP process. Further, there is a need in the art for methods and apparatus to monitor and control in-situ mixing, and thus the composition, of polishing fluids at or proximate to the point-of-use.

SUMMARY

Embodiments of the present disclosure generally provide methods and apparatus for monitoring and controlling relative concentrations of polishing fluid additives and, or, the distribution of a polishing fluid and, or, polishing fluid additives across the surface of a polishing pad.

In one embodiment, a method of polishing a substrate includes delivering a polishing fluid to one or more locations on a polishing surface of a polishing pad, wherein the polishing fluid comprises an optical marker; detecting optical information at a plurality of locations across a scan region of the polishing surface using an optical sensor facing theretowards; communicating the optical information to a system controller; determining a polishing fluid distribution across the scan region using the optical information; and changing an aspect of the delivery of the polishing fluid based on the polishing fluid distribution.

In another embodiment a computer readable medium having instructions stored thereon for performing a method of polishing a substrate when executed by a system controller is provided. Here, the method executed by the system controller comprises delivering a polishing fluid to one or more locations on a polishing surface of a polishing pad, wherein the polishing fluid comprises an optical marker; detecting optical information at a plurality of locations across a scan region of the polishing surface using an optical sensor facing theretowards; communicating the optical information to a system controller; determining a polishing fluid distribution across the scan region using the optical information; and changing an aspect of the delivery of the polishing fluid based on the polishing fluid distribution.

In another embodiment, a polishing system includes a polishing platen having a polishing pad mounting surface; a substrate carrier; a fluid delivery system; an optical sensor facing the polishing pad mounting surface; and one or more light sources positioned to illuminate at least a portion of a polishing pad disposed on the polishing platen.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Embodiments of the present disclosure generally provide methods and apparatus for monitoring and controlling relative concentrations of polishing fluid additives and, or, the distribution of a polishing fluid and, or, polishing fluid additives across the surface of a polishing pad. Embodiments herein use an optical sensor, such as a camera, to detect the distribution of a polishing fluid, additives thereof, and, or, concentrations of the additives across the surface of a polishing pad. Typically, the polishing fluid and or the polishing fluid additives comprise an optical marker, such as a dye, that is detected by the optical sensor and communicated to a system controller. The system controller than uses the information obtained from the optical sensor to adjust the concentration of one or more polishing fluid additives, adjust the distribution of the polishing fluid or one or more polishing fluid additives on the polishing pad, or a combination thereof.

Figure 1A:
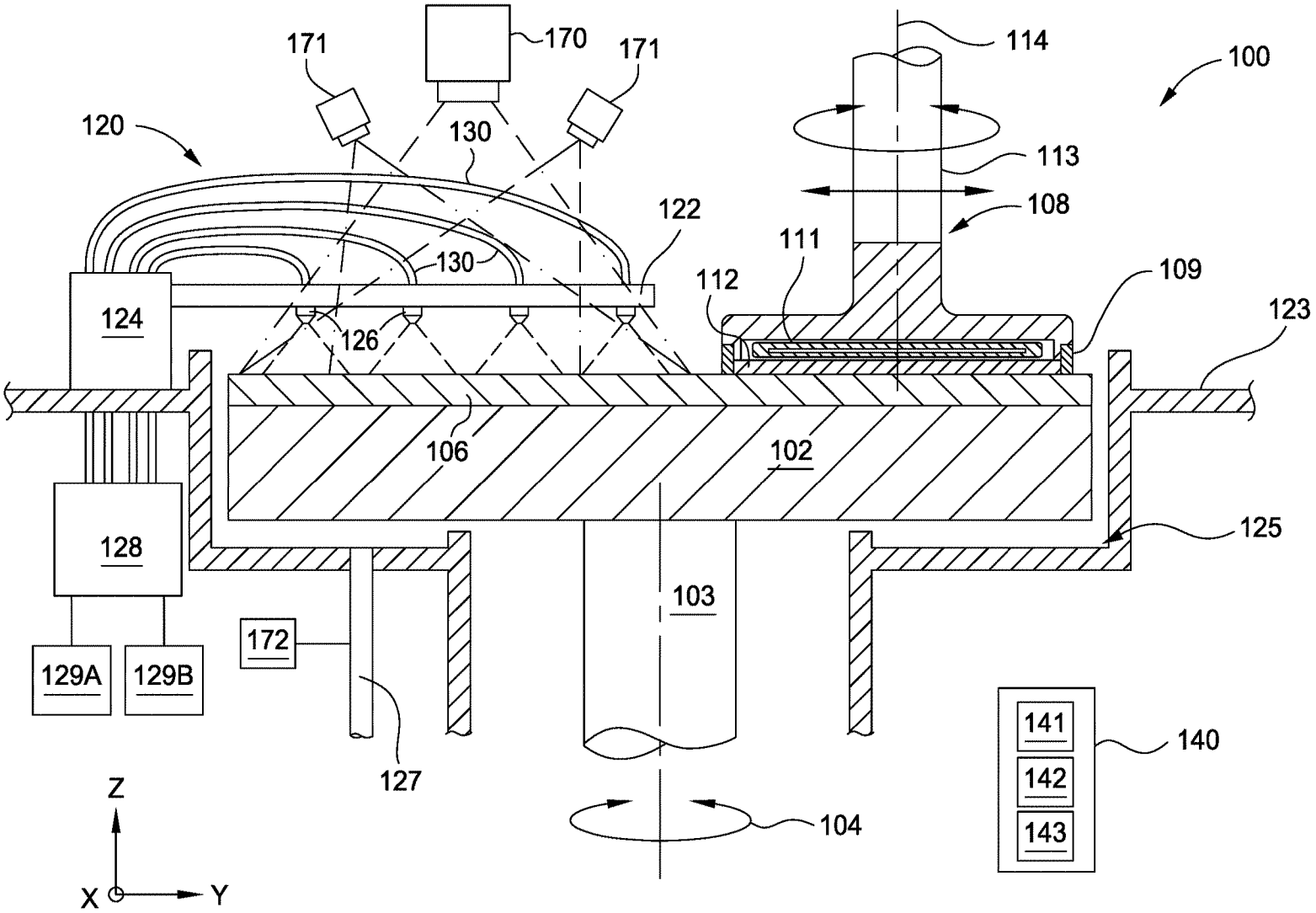
FIG. 1A is a schematic cross sectional view of an exemplary polishing system configured to practice the methods described herein, according to some embodiments.
Figure 1B:
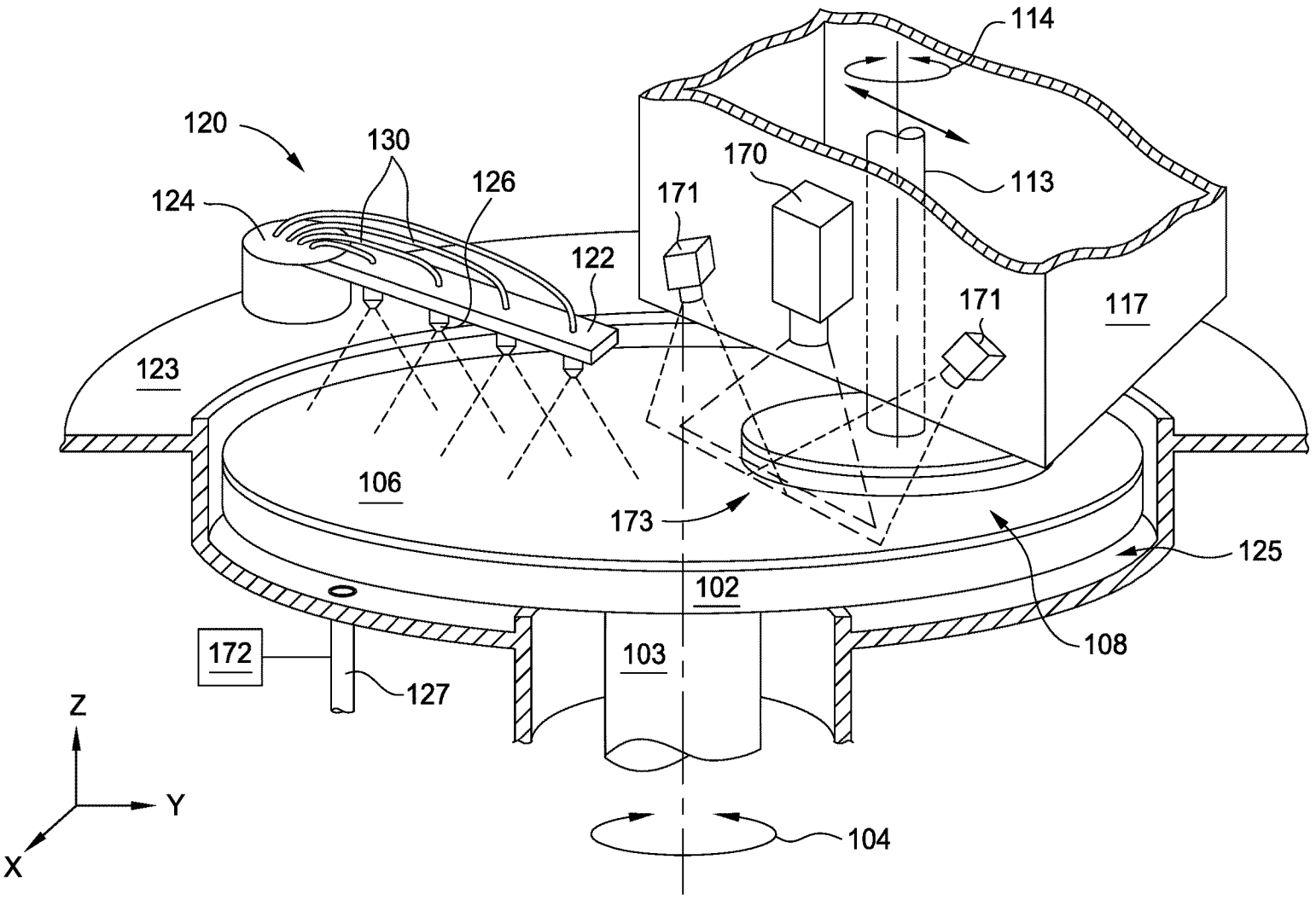
FIG. 1B is a schematic isometric view of the exemplary polishing system described in FIG. 1A.

FIG. 1A is a schematic sectional view of an exemplary polishing system 100 configured to practice the methods described herein, according to one embodiment. FIG. 1B is a schematic isometric view of the exemplary polishing system described in FIG. 1A where a portion of a base plate 123 is removed and further including a carriage housing 117 having an optical sensor 170 and one or more light sources 171 coupled thereto.

The polishing system 100 typically includes a polishing platen 102 rotatably disposed about a platen axis 104, a polishing pad 106 mounted on a surface of the polishing platen 102, a substrate carrier 108 rotatably disposed about a carrier axis 114, an optical sensor 170 for detecting optical markers in a polishing fluid or in additives thereof and, or, the distribution a polishing fluid and, or, additives thereof onto the polishing surface of the polishing pad 106, and a fluid delivery system 120 for delivering one or more polishing fluids or additives to the polishing surface of the polishing pad 106. In some embodiments, the polishing system 100 further includes a pad conditioning apparatus (not shown) for maintaining a desired surface texture on the polishing pad 106. In some embodiments, the polishing system further includes an endpoint detection system (not shown), such as an optical endpoint detection system or an eddy current endpoint detection system, used to monitor material removal from the field surface of a substrate and to detect when a material layer is cleared or begins to clear from the field surface of the substrate. Typically, the polishing pad 106 is secured to the polishing platen 102 using an adhesive, such as a pressure sensitive adhesive, disposed between the polishing pad 106 and the polishing platen 102.

The substrate carrier 108, facing the polishing platen 102 and the polishing pad 106 mounted thereon, includes a flexible diaphragm 111 configured to impose different pressures against different regions of a substrate 112 while urging the to be polished or being polished surface of the substrate 112 against the polishing surface of the polishing pad 106. The substrate carrier 108 further includes a carrier ring 109 surrounding the substrate 112. The substrate carrier 108 is coupled to a rotatable carrier shaft 113 which rotates the substrate carrier 108 about a carrier axis 114. During polishing, a downforce on the carrier ring 109 urges the carrier ring 109 against the polishing pad 106 which prevents the substrate 112 from laterally slipping from the region therebetween. Typically, the polishing platen 102 is disposed on a second shaft 103 operably coupled to a drive, such as a motor, which rotates the polishing platen 102 about a platen axis 104 while the substrate carrier 108 sweeps back and forth from an inner diameter of the polishing platen 102 to an outer diameter of the polishing platen 102 to, in part, reduce uneven wear of the polishing pad 106. Herein, the polishing platen 102 and the polishing pad 106 have a surface area that is greater than a to be polished surface area of the substrate 112.

The optical sensor 170 is positioned facing the polishing surface of the polishing pad 106 and detects one or more optical markers in the polishing fluid and, or, in polishing fluid additives, and the distribution thereof across a region of the polishing pad, such as the scan region 173. Herein, the scan region 173 describes the region on the surface of the moving polishing pad 106 from which information is captured by the optical sensor 170 at a point in time when the polishing pad 106 passes thereunder so that the scan region 173 remains stationary with respect to the optical sensor 170 and the polishing system surface coupled thereto. Herein, the optical sensor 170 comprises a camera, such as a frame camera, for example an RGB frame camera or a monochrome frame camera, or a line scan camera, for example an RGB line scan camera or a monochrome line scan camera. The optical sensor 170 detects optical information comprising light wavelengths and, or, light intensity, reflected by and, or, emitted by the one or more optical markers or a mixture of the one or more optical markers at a plurality of locations and converts this optical information into pixels, within the scan region. Thus, the optical information typically comprises spatial information, light wavelength, and light intensity. In other embodiments, the optical sensor 170 comprises one or more optical spectrometers positioned to measure light reflected by or emitted by one or more optical markers at a respective scan location. In some other embodiments, the optical sensor 170 comprises an imaging spectrometer.

The optical information obtained from the optical sensor 170 is communicated to a system controller 140 which determines a distribution of the polishing fluid or polishing fluid additive and, or, a polishing fluid composition across the scan region. Herein, the optical sensor 170 is communicatively coupled to the system controller 140 through a wired or wireless communication link (not shown). In some embodiments, the system controller 140 compares the distribution of the polishing fluid or fluid additive and, or, the composition of the polishing fluid to a desired distribution or composition and then changes the polishing fluid and, or, polishing additive distribution and, or, the polishing fluid composition as set forth in the methods of FIGS. 2 and 3.

Typically, the optical sensor 170 is mounted on or otherwise coupled to a mounting surface of the polishing system 100 that is maintained in a relatively stationary position during substrate polishing. In some embodiments, the optical sensor 170 is coupled to a carriage housing, such as the carriage housing 117 shown in FIG. 1B, which is disposed about the rotatable carrier shaft 113 coupled to the substrate carrier 108. Herein, the carriage housing 117 remains stationary relative to the rotating and sweeping substrate carrier 108 and the rotating polishing pad 106 disposed thereunder during substrate polishing. Typically, the optical sensor 170 is positioned to detect the polishing fluid distribution and, or, composition of the polishing fluid disposed on the polishing pad 106 after the polishing fluid or fluid additive is dispensed thereon using the fluid dispense arm 122 but before the polishing pad 106 passes under the substrate carrier 108. In other embodiments, the optical sensor 170 is positioned to detect the polishing fluid distribution and, or, composition on the polishing pad 106 after the polishing pad 106 passes under the substrate carrier 108 but before the polishing pad 106 passes under the polishing fluid dispense arm 122. In some other embodiments, the polishing system 100 comprises a plurality of optical sensors 170 where each of the plurality of optical sensors 170 is positioned to detect the polishing fluid distribution and, or, composition thereof before and, or, after, the polishing pad 106 passes under the substrate carrier 108, the fluid dispense arm 122, and, or, a pad conditioning apparatus (not shown). In other embodiments, the polishing system comprises a plurality of optical sensors 170 where each of the plurality of optical sensors 170 is positioned to detect one or both of a polishing fluid distribution or composition across a scanning region comprising a specific radial zone of the polishing pad.

Typically, the one or more optical markers comprise a dye, such as a conventional water soluble dye or a fluorescent dye. Examples of fluorescent dyes include, but are not limited to, coumarin series dyes, fluorescein, rhodamine series dyes, stilbene series dyes, eosin RDC series dyes, cresyl violet QUI, PBBO (2-[1,1'-biphenyl]-4-yl-6-phenylbenzoxazole), DPS (4,4"-(1,2-ethenediyl)bis-1,1'-biphenyl), BiBuQ Butyl-PBD (2-(4-Biphenylyl)-5-(4-t-butylphenyl)-1,3,4-oxadiazol), DCM (4-(Dicyanomethylene)-2-methyl-6-(4-dimethylaminostyryl)-4H-pyran), DMQ (2-methyl-5-t-butyl-p-quaterphenyl), or combinations thereof. In some embodiments, the one or more optical markers comprise a chromophore or fluorophore which are covalently bonded to one or more components of the polishing fluid or a polishing fluid additive.

In some embodiments, the polishing system 100 further includes one or more light sources 171, such as one or more LED light sources, for example red, green, or blue LED light sources, positioned facing the polishing surface of the polishing pad 106 and directing light theretowards to illuminate at least the scan region of polishing pad surface as it passes thereunder. In other embodiments, the one or more light sources 171 are UV light sources. The one or more light sources 171 are mounted on and, or, otherwise coupled to a surface of the polishing system 100 that is maintained in a stationary position relative to the substrate carrier 108 and the polishing platen 102 during substrate polishing, such as the carriage housing 117 shown in FIG. 1B.

Herein, the one or more polishing fluids are delivered to the polishing pad 106 before and during polishing of the substrate 112 using the fluid delivery system 120. The fluid delivery system 120 includes the fluid dispense arm 122 coupled to an actuator 124 that positions the fluid dispense arm 122 above the polishing pad 106 by swinging the fluid dispense arm 122 thereover and, or, lowering the fluid dispense arm 122 theretowards. Herein, the actuator 124 is disposed on, or through, a base plate 123 surrounding the polishing platen 102 where at least a portion of the base plate 123 defines a drainage basin 125 that collects and drains polishing fluids and, or, polishing fluid byproducts through a drain 127 in fluid communication therewith. Herein, polishing fluids are delivered to the polishing pad 106 via one or more delivery lines 130 in fluid communication with a fluid distribution system 128. The fluid distribution system 128 is fluidly coupled to one or more fluid sources, such as fluid sources 129A-B, which herein deliver polishing fluids, polishing fluid additives, cleaning fluids, deionized water, concentrated optical marker disposed in solution, or combinations thereof, to the fluid distribution system 128. In some embodiments, the fluid distribution system 128 includes an in-situ polishing fluid mixer (not shown).

In some embodiments, the polishing system 100 further includes an optical detection device 172 coupled to, or disposed proximate to, the drain 127. In some embodiments, the optical detection device 172 comprises a camera, such as the cameras described with respect to the optical sensor 170. In other embodiments, the optical detection device 172 comprises a spectrometer. The optical detection device 172 measures a light intensity or light wavelength reflected by and, or, emitted by an optical marker contained in the polishing fluid or polishing fluid byproducts and communicates the measurements to the system controller 140 via a wired or wireless communication link (not shown). The measurements are used by the system controller 140 to determine the relative concentration of one fluid component, such as a polishing fluid additive, in the polishing fluid or polishing fluid byproducts. In some embodiments, the system controller 140 changes the composition of the polishing fluid delivered to the polishing pad 106 by changing the concentration of at least one of the one or more additives thereof based on the measurements obtained from the optical detection device 172. Typically, the optical detection device 172 further comprises a light source, such as an LED light source, a UV light source, or a laser to illuminate the polishing fluid and polishing fluid byproducts flowing through the drain.

Herein, the fluid delivery system 120 further includes a plurality of dispense nozzles 126, such as drip nozzles, spray nozzles, or a combination thereof. Each of the dispense nozzles are fluidly coupled to a respective delivery line 130. Each of the dispense nozzles 126 is positioned at a different location along a length of the fluid dispense arm 122 so that each of the dispense nozzles 126 deliver a polishing fluid, or fluid additive, to a different radial location on the polishing pad 106 as the polishing pad 106 passes thereunder. In some embodiments, each of the delivery lines 130 is independently coupled to a respective valve (not shown) or flow controller (not shown) which controls the flow and, or, flowrate of the polishing fluid, or the fluid additive, therethrough to allow for spatial dosing of the polishing fluid and, or, a polishing fluid additive at respective radial locations on the polishing pad 106.

The system controller 140 herein includes a programmable central processing unit (CPU) 141 that is operable with a memory 142 (e.g., non-volatile memory) and support circuits 143. The support circuits 143 are conventionally coupled to the CPU 141 and comprise cache, clock circuits, input/output subsystems, power supplies, and the like, and combinations thereof coupled to the various components the polishing system 100, to facilitate control of a substrate polishing process.

To facilitate control of a polishing system 100 the CPU 141 is one of any form of general purpose computer processor used in an industrial setting, such as a programmable logic controller (PLC), for controlling various polishing system component and sub-processors. The memory 142, coupled to the CPU 141, is non-transitory and is typically one or more of readily available memories such as random access memory (RAM), read only memory (ROM), floppy disk drive, hard disk, or any other form of digital storage, local or remote.

Herein, the memory 142 is in the form of a computer-readable storage media containing instructions (e.g., non-volatile memory), that when executed by the CPU 141, facilitates the operation of the polishing system 100. The instructions in the memory 142 are in the form of a program product such as a program that implements the methods of the present disclosure (e.g. middleware application, equipment software application etc.). The program code may conform to any one of a number of different programming languages. In one example, the disclosure may be implemented as a program product stored on computer-readable storage media for use with a computer system. The program(s) of the program product define functions of the embodiments (including the methods described herein).

Illustrative computer-readable storage media include, but are not limited to: (i) non-writable storage media (e.g., read-only memory devices within a computer such as CD-ROM disks readable by a CD-ROM drive, flash memory, ROM chips or any type of solid-state non-volatile semiconductor memory) on which information is permanently stored; and (ii) writable storage media (e.g., floppy disks within a diskette drive or hard-disk drive or any type of solid-state random-access semiconductor memory) on which alterable information is stored. Such computer-readable storage media, when carrying computer-readable instructions that direct the functions of the methods described herein, are embodiments of the present disclosure.

Figure 2:
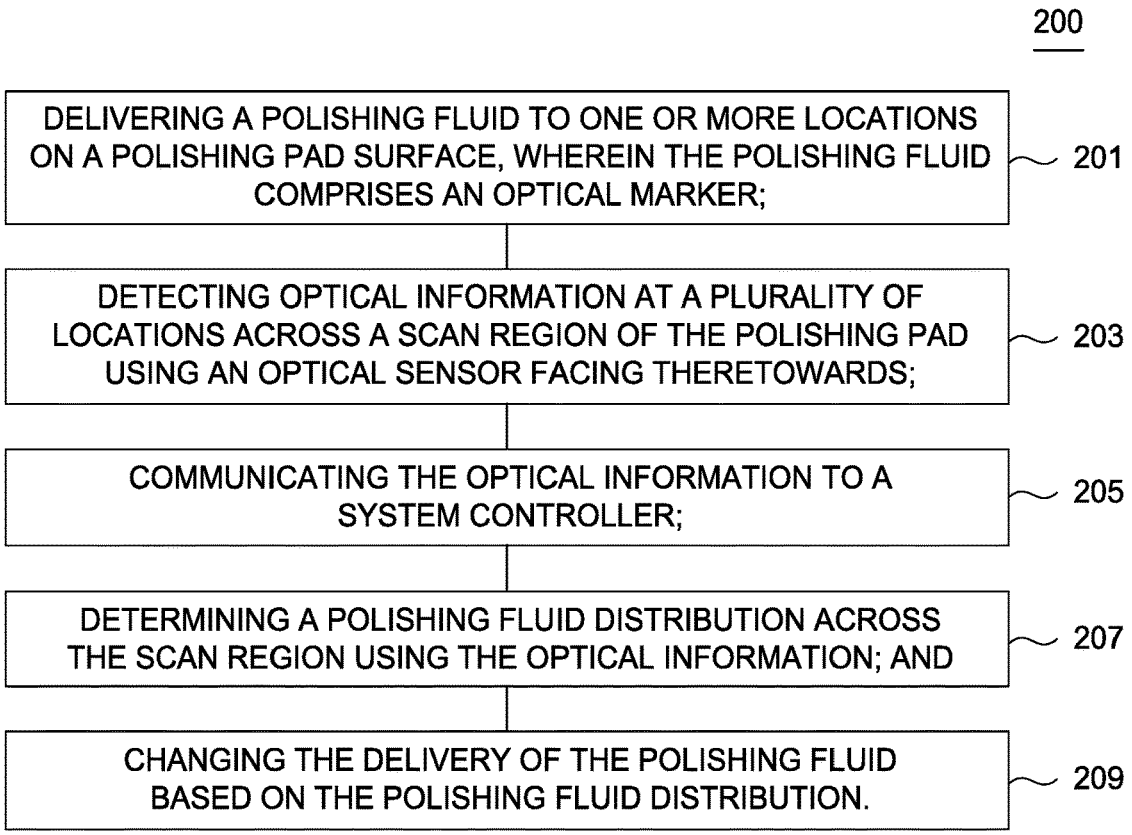
FIG. 2 is a flow diagram of a method of polishing a substrate, according to some embodiments.

FIG. 2 is a flow diagram of a method of polishing a substrate, according to one embodiment. At activity 201 the method 200 includes delivering a polishing fluid to one or more locations on a polishing surface of a polishing pad. Herein, the polishing fluid comprises an optical marker such as a conventional water soluble dye or a fluorescent dye. In some embodiments, the polishing fluid comprises a chromophore or fluorophore covalently bonded to one or more components thereof. For example, in some embodiments, the polishing fluid comprises a chromophore or fluorophore covalently bonded to abrasives of, and suspended in, the polishing fluid.

At activity 203 the method 200 includes detecting optical information at a plurality of locations across a scan region of the polishing pad using an optical sensor facing theretowards. In some embodiments, the optical sensor comprises a camera, such as a frame camera or a line scan camera and the plurality of locations correspond to pixels in an image captured by the camera. At activity 205 the method 200 includes communicating the optical information to a system controller. Herein, the optical information includes spatial information, e.g., pixels, and light intensity information. In some embodiments, such as embodiments where the camera is an RGB frame camera or an RGB line scan camera, the optical information further includes light wavelength.

At activity 207 the method 200 includes determining a polishing fluid distribution across the scan region using the optical information. In some embodiments, for example embodiments where the optical marker comprises a fluorescent dye or a fluorophore, the light intensity, and variations of light intensity, indicate the amount of polishing fluid and variations in the amount of polishing fluid as distributed across the scan region. In other embodiments, such as embodiments where the optical marker comprises a conventional water soluble dye or a chromophore, light wavelength (i.e., the color of light reflected by the optical marker) and, or, the light intensity indicates the composition of polishing fluid and variations in the amount of polishing fluid additives in the polishing fluid as distributed across the scan region.

In other embodiments, the method 200 includes determining a polishing fluid composition, such as a concentration of one or more additives in the polishing fluid. For example, in some embodiments, the polishing fluid comprises a mixture of a plurality of fluid components, such as one or more additives, each comprising a different color optical marker, typically a different color water soluble dye, for example a red dye, a blue dye, and, or, a green dye. Thus, the color of the resulting polishing fluid, and the wavelength of light reflected therefrom, can be used to determine the composition of the resulting mixture, i.e., the relative amounts of each of the plurality of fluid components. Typically, the plurality of fluid components are mixed using an in-situ mixer of a point-of-use fluid distribution system before the resulting polishing fluid is delivered to the polishing pad. In such embodiments, the optical sensor typically comprises an RGB frame camera or an RGB line scan camera.

At activity 209 the method 200 includes changing the delivery of the polishing fluid. Herein, changing the delivery of the polishing fluid includes changing one or more flow-rates of the polishing fluid respectively delivered to one or more radial locations on the polishing pad, changing a delivery location, changing the composition of the polishing fluid, or a combination thereof. In some embodiments, the method 200 further includes illuminating the scan region of the polishing surface using one or more light sources, such as an LED light source, for example a red, green, or blue LED light source or a UV light source, facing theretowards.

Figure 3:
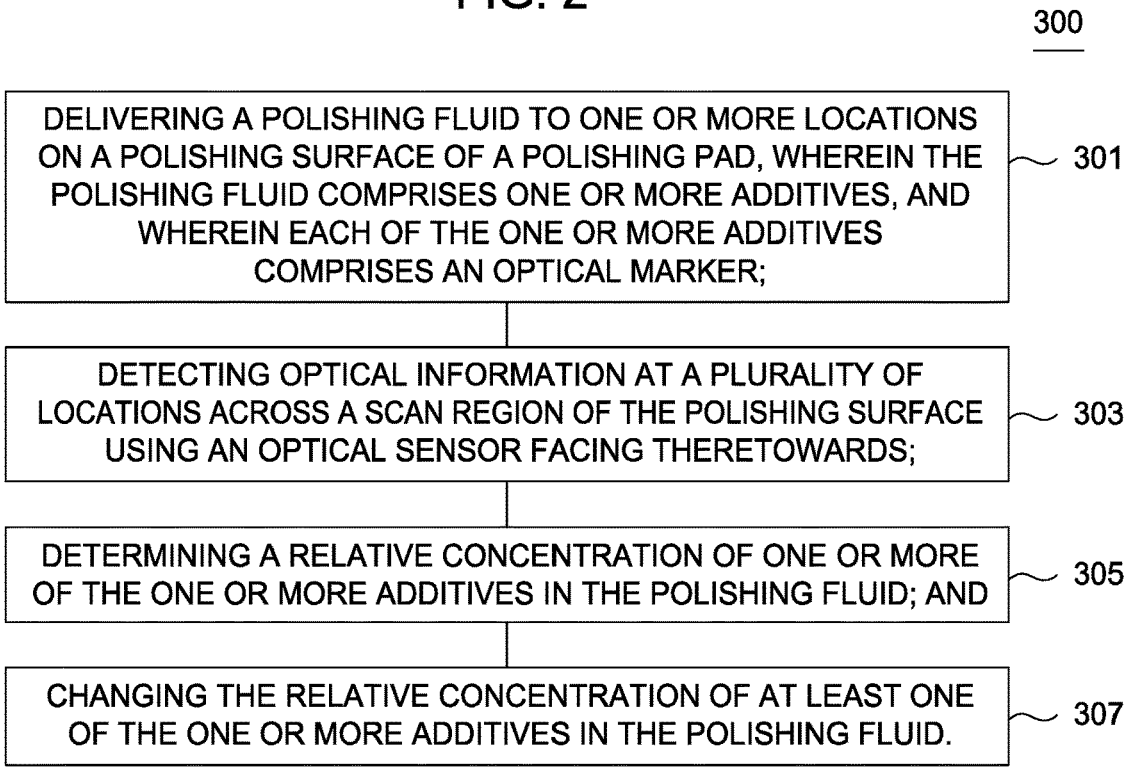
FIG. 3 is a flow diagram of a method of polishing a substrate, according to some embodiments.

FIG. 3 is a flow diagram of a method of polishing a substrate, according to another embodiment. At activity 301 the method 300 includes delivering a polishing fluid to one or more locations on a polishing surface of a polishing pad, wherein the polishing fluid comprises one or more additives, and wherein each of the one or more additives comprises an optical marker. In some embodiments, such as embodiments where the polishing fluid comprises a plurality of additives, each of the respective optical markers thereof will comprise a different color, such as red, blue, or green and the resulting polishing fluid will be a color that is a combination of the color of the respective optical markers, for example violet.

At activity 303 the method 300 includes detecting optical information at a plurality of locations across a scan region of the polishing surface using an optical sensor facing theretowards. Typically, the optical information includes spatial information, light intensity, and light wavelength. In some embodiments, the spatial information comprises pixels of an image captured by the optical sensor, e.g., camera, where each pixel corresponds to a location of the plurality of locations of the scan region. At activity 305 the method 300 includes determining a relative concentration of one or more of the one or more additives in the polishing fluid. At activity 307 the method 300 includes changing the relative concentration of at least one of the one or more additives in the polishing fluid. Typically, the concentration of the one or more additives is changed using an in-situ flow mixer before the resulting polishing fluid is delivered to the polishing surface of the polishing pad. In some embodiments, the optical sensor comprises a camera, such as an RGB frame camera, an RGB line scan camera, a monochromatic frame camera, or a monochromatic line scan camera. In some embodiments, the method 300 further includes illuminating the scan region using one or more light sources, such as an LED light source or a UV light source, facing theretowards.

In some embodiments, a wavelength of light emitted by an LED light source corresponds to a color of an optical marker used in at least one of the additives of the polishing fluid, for example a red LED light source and a red dye.

Embodiments herein provide for real time (feed forward) monitoring and control of polishing fluid distribution on a polishing surface of a polishing pad and, or, in-situ monitoring and control of point-of-use polishing fluid mixing. Monitoring and control of polishing fluid distribution across the polishing surface of the polishing pad enables at least reduced consumption of polishing fluid without risk of inconsistent material layer removal rates, poor removal rate uniformity, or the increased defectivity, e.g., micro-scratching resulting from insufficient polishing fluid at the interface between the substrate and the polishing pad. In-situ monitoring and control of point-of-use polishing fluid mixing enables fine control over additive concentration for specific CMP processes or for particular portions of a CMP process sequence. Typically, the distribution of one or more additives on the surface of the polishing pad or the concentration of one or more additives in the polishing fluid affects the polishing material removal rate, material removal rate uniformity, planarization and process planarization efficiency, within die material layer thickness uniformity, and post CMP defectivity of the polishing process for a given set of polishing conditions. Therefore, in some embodiments, changing an aspect of the delivery of the polishing fluid or changing the concentration of one or more additives in the polishing fluid changes one or more of polishing material removal rate, material removal rate uniformity, planarization and process planarization efficiency, within die material layer thickness uniformity, and post CMP defectivity of the polishing process for a given set of polishing conditions.

Distribution of one or more additives on the surface of the polishing pad or the concentration of one or more additives in the polishing fluid also affects material removal rate selectivity. For example, one CMP process that would benefit from point-of-use polishing fluid mixing is shallow trench isolation (STI) CMP. In STI CMP, polishing is used to remove a trench fill material, such as silicon oxide, from the exposed surface (field) of a layer having a plurality of trenches formed therein. For STI CMP processes it is desirable to have a high material removal rate when removing the bulk of the trench fill material layer from the field and a very low removal rate for an underlying stop layer, typically silicon nitride, disposed on the field surface under the trench fill material layer. Unfortunately, polishing fluid mixtures that enable high removal rates of bulk trench fill material often have poor removal rate selectivity with respect to the underlying stop layer, where removal rate selectivity is a ratio of removal rate of trench fill material layer to the removal rate of the stop layer material. Therefore, in some embodiments changing an aspect of the delivery of the polishing fluid based on the polishing fluid distribution changes a material removal rate selectivity of the polishing process. In other embodiments, changing the composition of the polishing fluid by changing the concentration of at least one of the one or more additives thereof includes changes a removal rate selectivity of the polishing fluid for a given set of polishing conditions.

While the foregoing is directed to embodiments of the present disclosure, other and further embodiments of the disclosure may be devised without departing from the basic scope thereof, and the scope thereof is determined by the claims that follow.

The invention claimed is:

1. A method of polishing a substrate, comprising:

delivering a polishing fluid to one or more locations on a polishing surface of a polishing pad, wherein the polishing fluid comprises an optical marker;

detecting optical information at a plurality of locations across a scan region of the polishing surface using an optical sensor facing theretowards;

communicating the optical information to a system controller;

determining a polishing fluid distribution across the scan region using the optical information; and changing an aspect of the delivery of the polishing fluid based on the polishing fluid distribution, wherein the optical information comprises spatial information comprising pixels of an image captured by the optical sensor, each pixel corresponding to a location of the plurality of locations.

2. The method of claim 1, wherein changing the aspect of the delivery of the polishing fluid comprises changing one or more flowrates of the polishing fluid respectively delivered to one or more radial locations on the polishing pad, changing a delivery location of the polishing fluid, changing a composition of the polishing fluid, or a combination thereof.

3. The method of claim 1, wherein the optical sensor comprises a camera.

4. The method of claim 3, wherein the camera is an RGB or monochrome line scan camera.

5. The method of claim 3, further comprising illuminating the scan region using one or more light sources facing theretowards.

6. The method of claim 5, wherein the one or more light sources are LED light sources, UV light sources, or a combination thereof.

7. The method of claim 6, wherein the optical marker is a fluorescent dye.

8. The method of claim 1, wherein the optical information further comprises light intensity.

9. The method of claim 8, wherein the optical information further comprises wavelength.

10. A computer readable medium having instructions stored thereon for performing a method of polishing a substrate when executed by a system controller, the method comprising: delivering a polishing fluid to one or more locations on a polishing surface of a polishing pad, wherein the polishing fluid comprises an optical marker; detecting optical information at a plurality of locations across a scan region of the polishing surface using an optical sensor facing theretowards; communicating the optical information to the system controller; determining a polishing fluid distribution across the scan region using the optical information; and changing an aspect of the delivery of the polishing fluid based on the polishing fluid distribution, wherein the optical information comprises spatial information comprising pixels of an image captured by the optical sensor, each pixel corresponding to a location of the plurality of locations.

11. The computer readable medium of claim 10, wherein changing an aspect of the delivery of the polishing fluid comprises changing one or more flowrates of the polishing fluid respectively delivered to one or more radial locations on the polishing pad, changing a delivery location of the polishing fluid, changing a composition of the polishing fluid, or a combination thereof.

12. The computer readable medium of claim 10, wherein the optical sensor comprises a camera.

13. The computer readable medium of claim 12, further comprising illuminating the scan region using one or more light sources facing theretowards.

14. The computer readable medium of claim 10, wherein the optical information further comprises light intensity.

15. The computer readable medium of claim 14, wherein the optical information further comprises wavelength.

16. A polishing system, comprising:

a polishing platen having a polishing pad mounting surface;

a substrate carrier;

a polishing fluid delivery system;

an optical sensor facing the polishing pad mounting surface;

one or more light sources positioned to illuminate at least a portion of a polishing pad disposed on the polishing platen;

a system controller; and a computer readable medium having instructions stored thereon for performing a method of polishing a substrate when executed by the system controller, the method comprising:

delivering a polishing fluid to one or more locations on a polishing surface of a polishing pad, wherein the polishing fluid comprises one or more additives, and wherein each of the one or more additives comprises an optical marker;

detecting optical information at a plurality of locations across a scan region of the polishing surface using the optical sensor;

communicating the optical information to the system controller;

determining a concentration of one or more of the one or more additives in the polishing fluid; and changing a composition of the polishing fluid by changing the concentration of at least one of the one or more additives thereof, wherein the optical information comprises spatial information comprising pixels of an image captured by the optical sensor, each pixel corresponding to a location of the plurality of locations.

17. The polishing system of claim 16, wherein the optical sensor comprises a camera.

* * * * *